US006884120B1

(12) United States Patent
Haba et al.

(10) Patent No.: US 6,884,120 B1
(45) Date of Patent: Apr. 26, 2005

(54) ARRAY CONNECTOR WITH DEFLECTABLE COUPLING STRUCTURE FOR MATING WITH OTHER COMPONENTS

(75) Inventors: Belgacem Haba, Cupertino, CA (US); Para Segaram, Campbell, CA (US); Joseph C. Fjelstad, Maple Valley, CA (US)

(73) Assignee: SiliconPipe, Inc., San Jose, CA (US)

( * ) Notice: Subject to any disclaimer, the term of this patent is extended or adjusted under 35 U.S.C. 154(b) by 0 days.

(21) Appl. No.: 10/608,255

(22) Filed: Jun. 27, 2003

Related U.S. Application Data

(60) Provisional application No. 60/392,239, filed on Jun. 27, 2002.

(51) Int. Cl.[7] ..... H01R 24/00
(52) U.S. Cl. ..... 439/630
(58) Field of Search ..... 439/630–633, 439/634–636, 161

(56) References Cited

U.S. PATENT DOCUMENTS

| | | | | |
|---|---|---|---|---|
| 4,621,882 A | | 11/1986 | Krumme | 439/161 |
| 5,015,193 A | | 5/1991 | Krumme et al. | 439/161 |
| 5,044,980 A | | 9/1991 | Krumme et al. | 439/496 |
| 5,423,691 A | * | 6/1995 | Pickles | 439/327 |
| 6,447,871 B1 | | 9/2002 | Hawkins | 428/67 |
| 2001/0010983 A1 | * | 8/2001 | Bricaud et al. | 439/630 |
| 2003/0203678 A1 | * | 10/2003 | Farnworth et al. | 439/630 |

* cited by examiner

*Primary Examiner*—Michael C. Zarroli

(74) *Attorney, Agent, or Firm*—Shemwell Gregory & Courtney LLP

(57) ABSTRACT

A connector is described which uses a coupling structure integrally formed from a plurality of discrete elements that are aligned to receive an insertion force. In response to the insertion force affecting some or all of the elements, the affected elements move from an original state into a deflected state. In the deflected state, the overall thickness of the coupling structure is reduced. The relationship between the coupling structure and a dimension of a cavity that is to be occupied by the coupling structure is such that when the thickness of the coupling structure is reduced, the dimension of the cavity is increased.

10 Claims, 10 Drawing Sheets

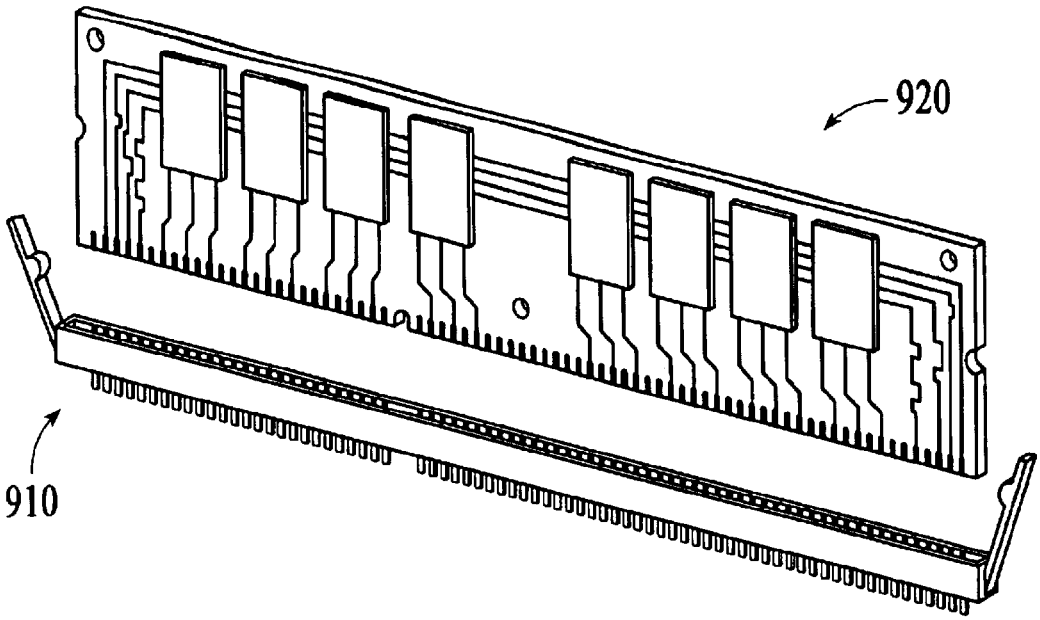
FIG.9A
FIG.9B
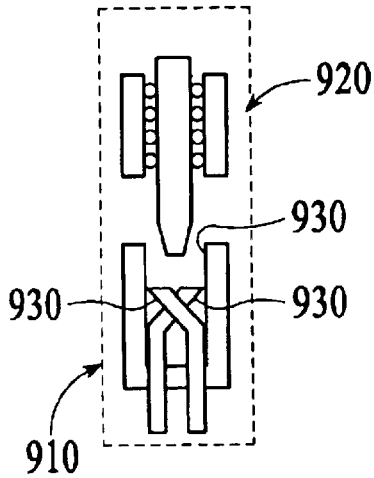

ARRAY CONNECTOR WITH DEFLECTABLE COUPLING STRUCTURE FOR MATING WITH OTHER COMPONENTS

RELATED APPLICATIONS

This application claims priority to U.S. Patent Application No. 60/392,239, entitled ZERO INSERTION FORCE HIGH PIN COUNT AREA ARRAY CONNECTOR, filed Jun. 27, 2002, the aforementioned application being hereby incorporated by reference.

TECHNICAL FIELD

The disclosed embodiments relate generally to the field of connectors. More particularly, the disclosed embodiments relate to a connector having a deflectable coupling structure for mating with other components.

BACKGROUND

In high-speed electronic signal transmission, electrical and electronic connectors are rapidly becoming a critical bottle-neck for achieving the desired levels of electronic performance. The list of demands for such connectors is increasing with advances in their applications. Among some of the requirements for next generation connectors are the following: low inductance, minimal signal distortion and reflections and matched impedance with the circuits serving the components which are being interconnected through the connector. In addition, future connectors may be required to have capabilities for rapidly addressing the need for increasingly high pin counts in a small area (high area pin density). Next generation connectors are also becoming smaller in form factor.

All of these demands and requirements have led to making what is an increasingly delicate electrical connection. The electrical connections, and the electrical contacts that form the connections are sensitive to the application of forces. However, reliable and robust mechanical connections are still necessary to connect devices to such connectors.

FIG. 9A and FIG. 9B illustrate a very common connector used in high-volume manufacturing. FIG. 9A shows a printed circuit board device 920 just before it is mounted into a connector 910. In FIG. 9B, the mechanical and electrical connections formed between the connector 910 and the circuit board device 920 are illustrated. A pair of spring contacts 930 serve as both electrical contacts and restraints to resist removal of the printed circuit board 920 after the board is inserted into an opening 940 of the connector 910. In a typical assembly, the spring contacts 930 provide wipe and a contact force between 10 and 20 grams per contact pair. The pitch between electrical contacts can be as low as 0.5 mm, but the pitch is also frequently greater. Typical materials used in making the spring contacts include beryllium-copper alloy.

While structures such as described in FIGS. 9A and 9B are suited for many type of applications, such structures exhibit very high inductance which can significantly degrade signal integrity. Furthermore, such structures are not small enough when arrays with high pin-counts are needed. The application of a mechanical force to the contacts also poses the problem that the contacts will be damaged, particularly when delicate or small contacts are needed to achieve high pin-count density and/or low inductance.

BRIEF DESCRIPTION OF THE DRAWINGS

FIG. 9A is a front isometric view of a prior art connector being mated with another component.

FIG. 9B is a side cross-sectional view of the prior art connector having a traditional mechanism for mating the connector with another component.

Figure 1A:
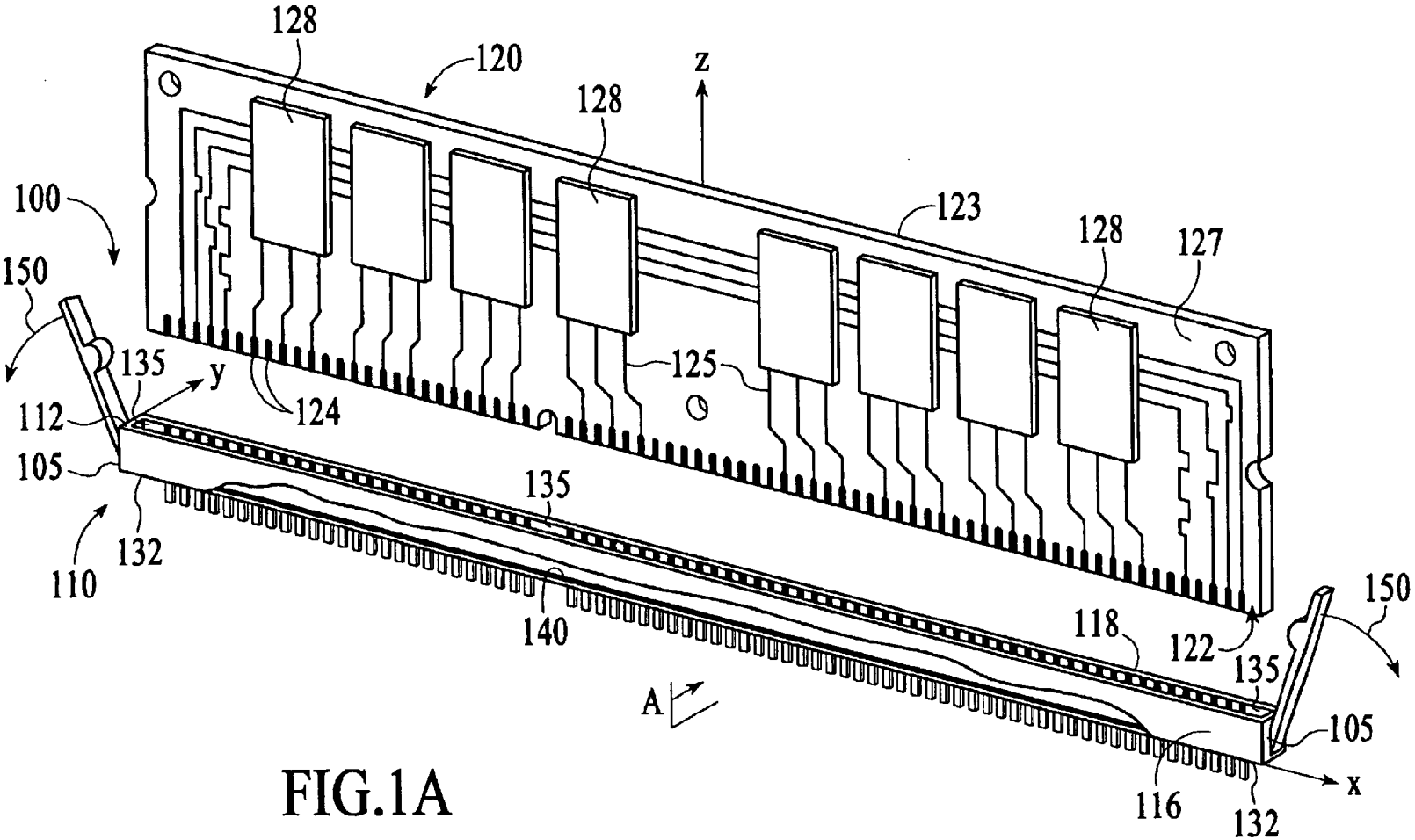
FIG. 1A is a front isometric view of a connector assembly having a connector and a mating component, with a cut-away that shows a coupling structure of the connector, according to an embodiment of the invention.

In the drawings, the same reference numbers identify identical or substantially similar elements or acts. To easily identify the discussion of any particular element or act, the most significant digit or digits in a reference number refer to the Figure number in which that element is first introduced (e.g., element 130 is first introduced and discussed with respect to FIG. 1). Any modifications necessary to the Figures can be readily made by one skilled in the relevant art based on the detailed description provided herein.

DETAILED DESCRIPTION

A. Overview

Embodiments described herein include a connector having a structure in which an interior cavity is provided. A coupling structure is disposed on a surface of the cavity. The coupling structure is integrally formed from a plurality of discrete elements that are aligned to receive an insertion force that is provided to insert a mating component into the interior cavity. In response to the insertion force affecting some or all of the elements, the affected elements move from an original state into a deflected state. In the deflected state, the overall thickness of the coupling structure is reduced. The relationship between the coupling structure and a dimension of the cavity is such that when the thickness of the coupling structure is reduced, the dimension of the cavity is increased. The direction that the cavity is increased corresponds to a direction in which the thickness of the coupling structure is reduced. This direction is orthogonal to the direction of the insertion force. Furthermore, once the elements are deflected, the elements are biased to tend towards returning to the original state, and to cause an expansion of the coupling structure in a direction that decreases the dimension of the cavity.

As used herein, any force that is used to cause the mating component to be received by the connector is an insertion force. In an embodiment, the insertion force occurs before the mating component is inserted into the cavity of the connector. For example, lever arms or an insertion tool may provide the insertion force that causes the aperture to increase its dimension and permit subsequent insertion of the mating component. In another embodiment, the insertion force may occur simultaneously, or concurrently, with the mating component being inserted into the cavity. For example, the insertion force may be caused by the mating component making contact with the coupling structure.

The term "integrally formed" means that the elements are physically coupled together. In one embodiment, the elements are disbursed in a common matrix material.

According to another embodiment, a connector assembly is provided that includes a first connector and a second connector. The first connector includes a mating section upon which contact elements are provided. A second connector includes a cavity for receiving the mating section. The second connector also includes contact elements for mating with the contact elements of the first connector. A coupling structure is disposed on a surface of at least one of the mating section and the cavity. The coupling structure is formed from a matrix material in which a plurality of discrete elements are disposed. Each of the plurality of elements are aligned to be affected by an insertion force coinciding with the mating section being inserted into the cavity. The discrete elements are constructed so that the insertion force is distributed substantially uniformly amongst some or all of the elements that form the coupling structure. The elements that are affected by the insertion force are forced into a deflected state. In the deflected state, the elements are biased, and the overall thickness of the coupling structure is reduced. A dimension of the cavity is too small to receive the mating section, unless the thickness of the coupling structure is reduced.

In such a connecting apparatus the coupling structure may be provided on a male connector, female connector or both.

B. Connector Configuration

FIG. 1A is an isometric view of a connector assembly 100 with a cut-away that illustrates a coupling structure 140, according to an embodiment of the invention. In a configuration such as shown in FIG. 1A, connector 110 is structured to receive a mating section 122 of the component 120 within a cavity 135. In an embodiment such as shown by FIG. 1A, mating component 120 may correspond to a circuit board mount or edge connector. The connector 110 establishes connectivity with contact surfaces 124 distributed on a front surface 127 of the mating component 120. The contact surfaces 124 are provided at a mating section 122 of the component 120. The contact surfaces 124 extend to circuitry 125 and/or electrical devices on a board 128.

As will be described, the coupling structure 140 of connector 110 has characteristics that enable the component 120 to be securely mated with connector 110, with no insertion forces being applied to the electrical contact surfaces 124. In one embodiment, little or no insertion force is applied to the mating component 120 as a whole. Rather, the insertion force is applied to the coupling structure 140, which deflects to allow the mating section 122 of the mating component 120 to be received. After the mating section is received, the coupling structure 140 also resists removal of the mating section 122 from the cavity 135. In this way, the connector 110 forms a stable and strong mechanical connection with the mating component 120. As a result, the electrical connections formed between the connector 110 and the mating component 120 are maintained and made more reliable. These electrical connections are not jeopardized by the mechanical connection formed with the coupling structure 140. Because little or no force is actually applied to the mating component 120 or its contact surfaces 124 during the insertion of mating section 122, the integrity of the electrical signals that pass between the connector 110 and the mating component 120 is maintained. Furthermore, smaller and more delicate electrical connections may be formed in order to increase array density and lower inductance.

With reference to FIG. 1A, connector 110 has a top end 112 and a bottom end 132 which define a height of the connector 110 (extending along an axis Z). The connector 110 has a length extending between lateral ends 105, 105 (along an axis X). A width of the connector 110 extends between a front surface 116 and a back surface 118 (along the axis Y). An opening of cavity 135 is provided at the top end 112. The mating component 120 is inserted into the cavity 135 in a downward direction from the top end 112. Within cavity 135, a plurality of electrical contact elements 146 (see FIG. 1B) are provided that extend to pins 136 or-other electrical contacts protruding from the bottom end 132 of connector 110. According to an embodiment, coupling structure 140 is also disposed on a surface that at least partially defines the cavity 135. In one embodiment, coupling structure 140 may extend lengthwise within the connector 110 along the axis X.

In an embodiment, a width of cavity 135 (extending along axis Y) is adjustable to receive the mating component 120. The mating component 120 fits within cavity 135 when the width of the cavity is increased, but not when it is reduced. The coupling structure 140 is positioned within the cavity 135 so that its thickness (extending in the direction of the Y axis) determines the dimension of the cavity width. Specifically, the thickness of the coupling structure 140 is inversely proportional to the width of the cavity 135. As will be described, an insertion force needs to be applied to the coupling structure 140 in order for the thickness of the coupling structure to be reduced and the cavity width to be increased. Thus, the mating component 120 can insert into and mate with connector 110 only when the insertion force is applied to the coupling structure 140. Absent the insertion force, an embodiment provides that the coupling structure 140 is at its greatest thickness, and the cavity 135 is at its least width.

The connector 10 may include lever arms 150 on each lateral end 105 to engage the coupling structure 140. The lever arms 150 are pivotally connected to the connector 110 so that each lever arm is moveable between a disengaged position (corresponding to the lever arm being raised) and an engaged position (corresponding to the lever arm being lowered) with respect to the coupling structure 140. The lever arms 150 may be lowered in order to provide the insertion force that results in adjustment of the width of cavity 135. Insertion of the mating section 122 of the mating component 120 may follow the application of the insertion force. For example, the mating section 122 may be inserted into the cavity 135 right after the insertion force is applied to the coupling structure 140. The manner in which the coupling structure 140 behaves in the present of an insertion force is described in greater detail with FIGS. 2A and 2B.

If the lever arms 150 are returned from the lowered position to the raised position, the insertion force is removed from the coupling structure 140. As will be described, one of the properties of the coupling structure 140 is that it is resilient. Thus, the coupling structure 140 biases when it is reduced in thickness. Once the lever arms 150 are lowered and the mating component 120 is inserted, the insertion force from the lever arms may be removed so that the natural bias of the coupling structure 140 presses the contact surfaces 124 of the mating component 120 into contact with electrical contact elements of the connector 110 (shown as element 146 in FIG. 1B). In one embodiment, coupling structure 140 is provided towards a back end of the cavity 135, so that it presses against a back surface 123 of the mating component 120. This allows the natural bias of the coupling structure 140 to stabilize and maintain the contact surfaces 124 in electrical connection with the corresponding electrical contact elements of the connector 110.

The natural bias provided by the coupling structure 140 also precludes removal of the mating component 120 with an ordinary removal force. In one embodiment, another insertion force has to be applied to the coupling structure 140 in order to increase or maintain the cavity width simultaneously with removal of the mating component 120 from the cavity 135. The insertion force may be re-applied by lowering the lever arms 150 once more. Once the lever arms 150 are lowered and the insertion force applied, the cavity width is sufficient to enable easy removal of the mating component 120 from the cavity 135.

Figure 1B:
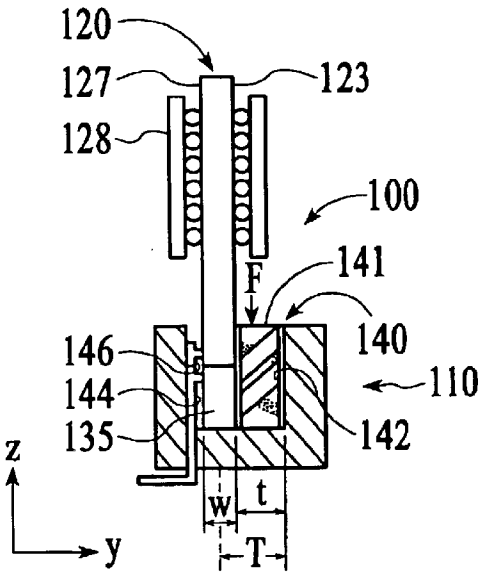
FIG. 1B is a side cross sectional view of the connector assembly shown in FIG. 1A.

FIG. 1B is a side cross-sectional view of FIG. 1A along lines A, but FIG. 1B shows the mating component 120 mated with connector 110. The coupling structure 140 is provided on a back wall 142 of cavity 135. The plurality of electrical contact elements 146 of connector 110 are provided on a front wall 144. In order to mate the connector 110 with the mating component 120, coupling structure 140 is deflected so that its thickness, represented by t, is reduced from its natural state. An insertion force F may be applied by the pair of lever arms 150 (FIG. 1A) to a contact surface 141 of the coupling structure. In one embodiment, the lever arms 150 only make contact with a small lengthwise portion of the overall contact surface 141, shown near the lateral sides 105, 105. But the insertion force F provided by engagement of the lever arms 150 is distributed evenly along the length of the coupling structure 140, so that the coupling structure deflects substantially uniformly. In an embodiment such as shown in FIG. 1B, the cavity width, represented by w, is sufficient to receive the mating section 122 only when the thickness t is reduced from its natural state. When the mating component 120 is inserted fully into the cavity 135, the coupling material 120 is biased to press against the back surface 123 of the mating component. The front surface 127 of mating component 120, where electrical contact surfaces 124 are located, is pressed by the bias of the coupling structure into the contact elements 146.

In FIG. 1B, the reference line T represents the full thickness of the coupling structure 140 in the absence of the insertion force. Inversely, the reference line T also illustrates the reduced width of the cavity 135 when the coupling structure 140 is in its original state, without the application of the insertion force F. As illustrated by the reference line T, in the absence of the mating component 120 and the shear force, the thickness of the coupling structure 140 is increased, while the width of the cavity is decreased.

Figure 1C:
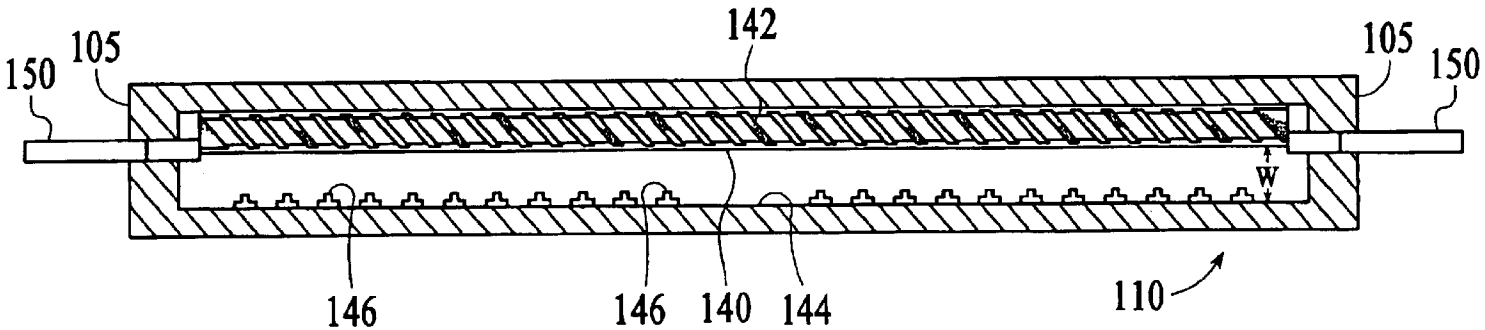
FIG. 1C is a top view of a connector of the connector assembly shown in FIG. 1A and FIG. 1B.

FIG. 1C is a top-view of connector 110, without mating component 120 inserted into cavity 135. The coupling structure 146 is provided on the back wall 142 of the cavity 135. Electrical contacts 146 of connector 110 are provided on the front wall 144. The lever arms 150 extend into the cavity 135 from the opposing lateral sides 105, 105. Without application of the insertion force by the lever arms 150, the width w of cavity 135 is not sufficient to accommodate the thickness of the mating section 1221 of the mating component 120. As described in FIGS. 2A and 2B, application of the insertion force may deflect or compress the coupling structure 140 towards the back wall 142, thereby increasing the width w in order to accommodate the mating section 122.

C. Coupling Structure

Figure 2B:
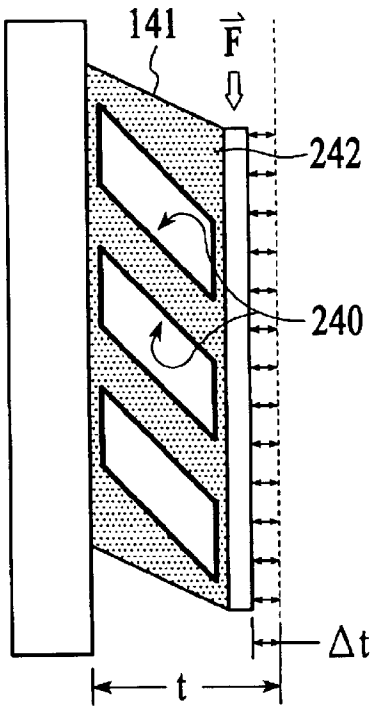
FIG. 2B is a side view of the coupling structure after application of an insertion force to mate a connector with another component.
Figure 2A:
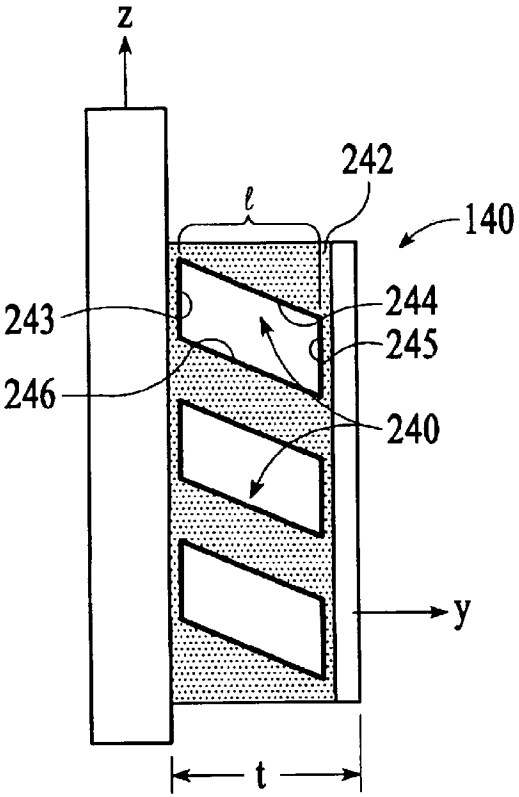
FIG. 2A is a side view of a coupling structure for use with a connector assembly, according to an embodiment of the invention.

FIG. 2A and FIG. 2B together illustrate construction and operation of the coupling structure 140, under an embodiment of the invention. FIG. 2A and FIG. 2B are representational side cross-sectional views of the coupling structure 140 before and after application of an insertion force. In FIG. 2A, the pair of lever arms 150 (FIG. 1A) are assumed to be in a disengaged position. In FIG. 2B, the lever arms 150 are assumed to be in an engaged position to deflect the coupling structure 140.

In an embodiment, coupling structure 140 is formed from a matrix material 242 and a plurality of deflectable elements 240 distributed in the matrix material. The deflectable elements 240 may be formed from semi-rigid materials using known processes, such as molding, machining, or extruding. In one embodiment, the deflectable elements 240 are elongated extrusions, formed from nylon or polyvinyl chloride ("PVC"). Other material suitable for the construction of the elements 240 include glass or metals, such as aluminum or steel. The matrix material may be cast around the elements 240. Suitable materials for the matrix material 242 include epoxy, although other polymers and plastics may also be used, such as polyester or vinylester resins. The matrix material 242 may be relatively soft and/or has a relatively low modulus compared to the material of the elements 240, in order to facilitate deflection of the coupling structure 140 as a whole. U.S. Pat. No. 6,447,871 discloses materials and construction of elements 240 and matrix material 242. The aforementioned issued patent is hereby incorporated by reference in its entirety for all purposes by this application.

In a configuration such as shown by FIG. 2A and FIG. 2B, multiple rows of the elements 240 are provided, with each row extending into the paper and including additional individual elements. The deflectable characteristics of the coupling structure 140 as a whole are provided primarily by the individual elements 240. The elements 240 are structured to modify the insertion force acting upon the coupling structure 140 to divert much of the insertion force in a direction that is different than that original direction of the force. The individual elements 240 may also absorb some of the insertion force.

While various shapes and structures are possible for each element 240, one embodiment provides that each element 240 is elongated in shape and asymmetrical in cross-section. Each element 240 may have a length l that extends primarily in the direction of axis Y. In a configuration such as shown by FIGS. 2A and 2B, the length l of each element extends a substantial portion of the overall thickness t of the coupling structure 140. Other configurations may stack the elements 140 in the direction of axis Y so that the overall thickness t includes the lengths of multiple elements 240. In the configuration of FIGS. 2A and 2B, the cross-sectional shape of each element 240 is Rhombus-shaped. Each element 240 includes two length members 244, 246 extending lengthwise between two connecting members 243, 245. Thus, the length members 244, 246 extend substantially the thickness of matrix 242. An embodiment provides that the length members are skewed with respect to the axes Y and Z. The axis Y may correspond to the axis of the overall thickness t of the overall coupling structure 140, while the axis Z is the primary direction of the insertion force (shown being applied in FIG. 2B). In one embodiment, the length members 244, 246 are substantially parallel and skewed with respect to the axis Y, so that a resulting shape of the element is a parallelogram.

FIG. 2B shows that the application of an insertion force F deflects the elements 240. In one embodiment, the insertion force F corresponds to a shear load that is distributed substantially uniformly amongst the elements 240 in all of the rows. As a result, each element 240 deflects about the same amount. The deflection of each element 240 results in the deflecting element becoming more skewed with respect to the axis Y. Specifically, the length members 244, 245 that are transverse to the insertion force F skew more, without increasing in length. The elements 240 are bound to the matrix 242 so that the change in the orientation of the length members causes the overall thickness t of the coupling structure 240 to become reduced. A change in the overall thickness t of the coupling structure 240 as a result of the application of the insertion force F is shown by $\Delta t$.

As described in FIGS. 1A–1C, the insertion force may correspond to the lever arms 150 (FIG. 1A) being lowered into an engaged position. The insertion force F occurs because the lever arms 150 are forced into the contact surface 141 of the coupling structure 140 (also see FIG. 1B). In an embodiment, the insertion force F is distributed substantially uniformly amongst a set of affected elements 240. In one embodiment, the affected elements 240 are all of the elements that form the coupling structure 140, including elements of each row shown in FIG. 2B.

According to embodiments of the invention, a suitable maximum cross-sectional dimension (length or width) for each element 240 of the coupling structure 140 is less than about 1 centimeter. One embodiment provides for the maximum cross-sectional dimension to be between 100 microns and 1 centimeter. Another embodiment provides that suitable range for the maximum cross-sectional dimension of each element is 500 microns to 5 millimeters. In addition, different types of cross-sectional shapes may be used in constructing the elements 240. For example, as an alternative to the Z-shape described above, individual elements 240 may have an hourglass shape, a cantilever shape or a leaf spring shape. U.S. Pat. No. 6,447,871 discloses several suitable constructions for coupling structure 140 using different elements 240, including the alternative cross-section shapes.

D. Coupling Structure Removal

Figure 3:
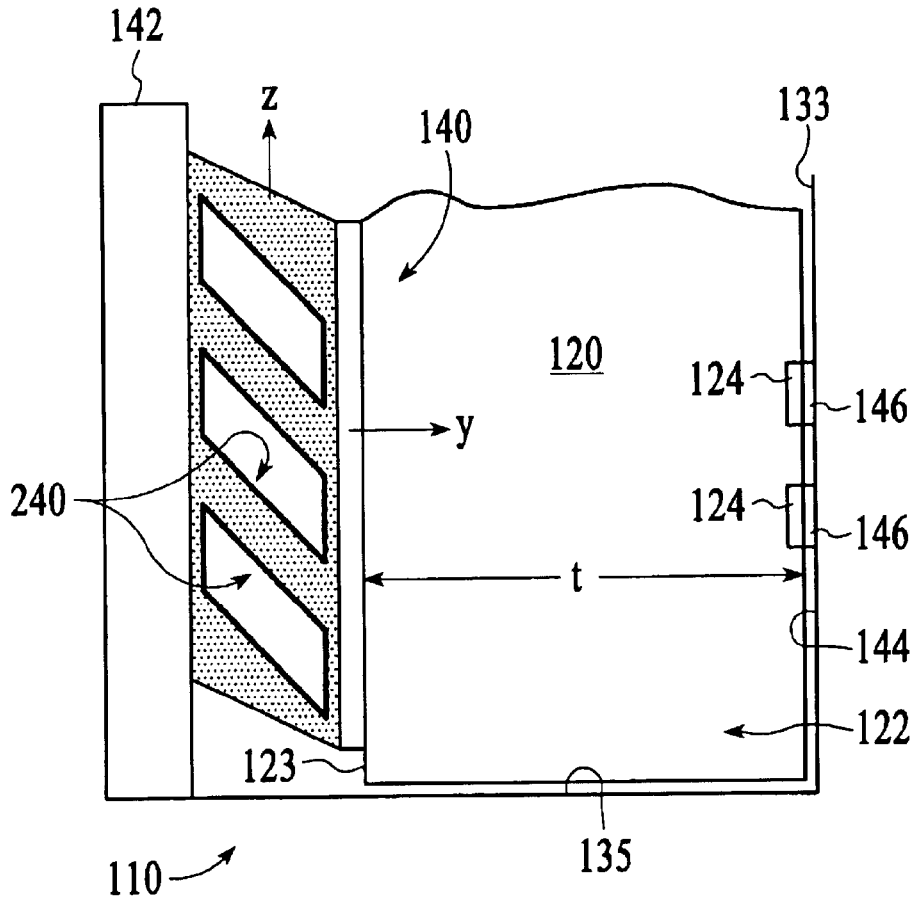
FIG. 3 is a side view of a coupling structure that is used to mechanically couple a connector to another component, under an embodiment of the invention.

FIG. 3 is a representative side cross sectional view of the mating component 120 inserted into the cavity 135. The coupling structure 140 is in a deflected state in order to accommodate the thickness of the mating section 122 of the component 120. In a configuration such as shown in FIG. 3, the coupling structure 140 is provided on back wall 142 of cavity 135. The contact elements 146 are on the front wall 144 of the cavity 135, so as to oppose the coupling structure 140 across the cavity.

The elements are constructed to bias when deflected. Thus, elements 240 are biased to tend towards returning to their original unbiased state (such as shown in FIG. 2A). The result is that once the mating section 122 is inserted, a lateral force (in the direction of the axis Y) is provided by the coupling structure 140 pressing against the back surface 123 of the mating section. The contact surfaces 124 are thus actively connected to the contact elements 146 of the connector 110.

In addition to providing bias for actively connecting the contact surfaces 124 and the contact elements 146, the orientation of the elements 240 in the deflected state impedes removal of the mating component 120 from the cavity 135. Any removal force that would act on the component 120 would require elements 240 to be moved back towards the original state (shown in FIG. 2A). The skewed orientation of the elements 240 means that the coupling structure 140 would have to increase in thickness and occupy more of the space within the cavity 135. Since the mating section 122 occupies all of the available space in the cavity 135, and a bias exists between the mating section and the coupling structure, any movement by mating section towards being removed from the cavity 135 would only serve to increase the existing bias.

The result is that the coupling structure actively resists any removal of the mating component 120 from the cavity. The resistance of the coupling structure 140 to removal of the mating component 120 may be relatively great, considering that removal would mean that the width of the cavity 135 would be tending towards decreasing simultaneously while the mating end 122 is present in the cavity. According to one embodiment, the insertion force has to be re-applied in order to allow for the mating section 122 to be removed from the cavity 135. Reapplying the insertion force may cause the coupling structure 140 to further reduce in thickness, or at least stay constant in thickness, so that the mating section 122 can be moved out of the cavity 135 without a bias force from the coupling structure precluding the movement.

E. Connector Configurations

Various difference connectors and connector schemes may incorporated with a coupling structure similar to described above, and with alternative embodiments described elsewhere in this application. FIGS. 4–7 illustrate specific connectors, mating components, and configurations to illustrate difference implementations of embodiments of the invention.

Figure 4:
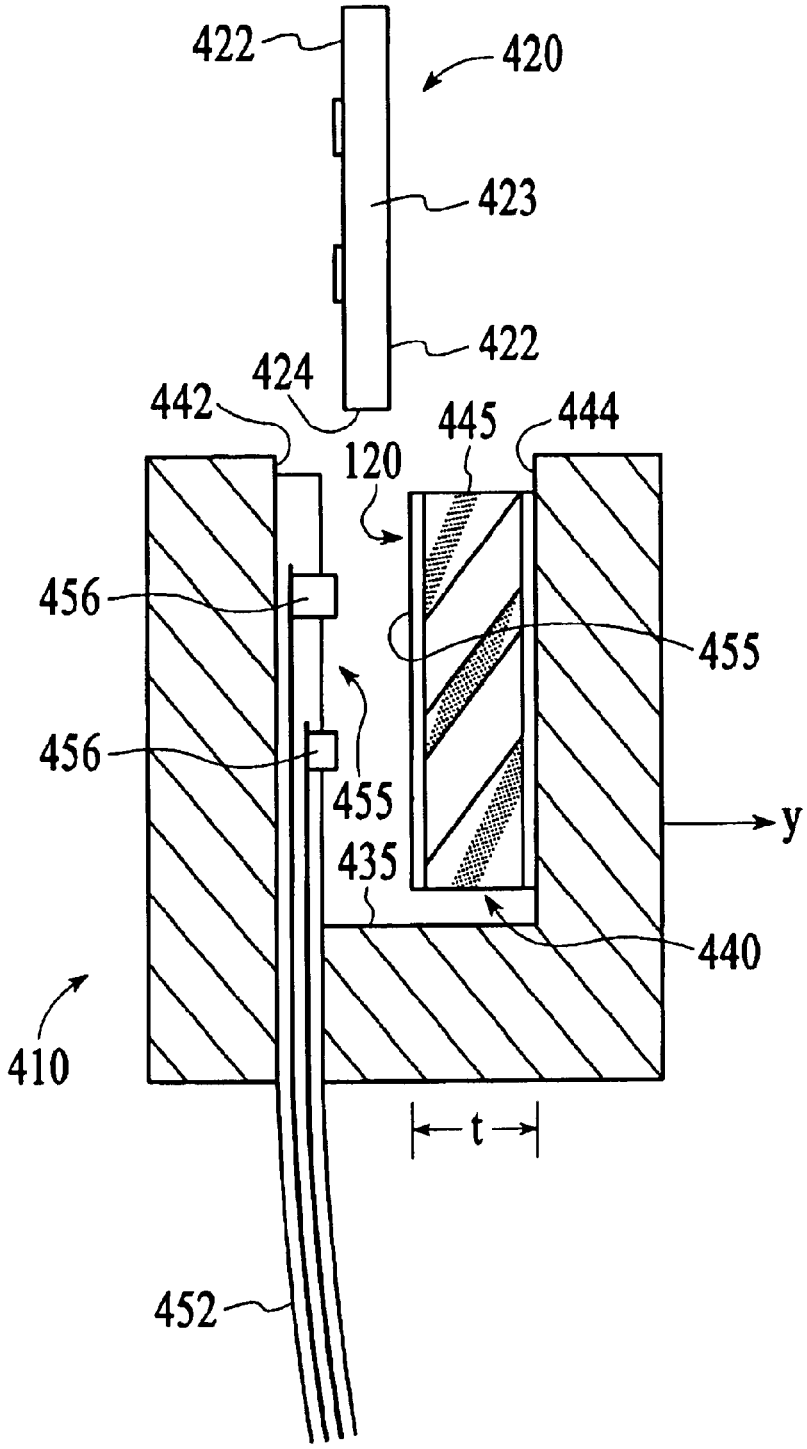
FIG. 4 is a side cross-sectional view of a connector adapted to include a coupling structure and a flex cable, under an embodiment of the invention.

FIG. 4 is a representative cross-sectional view of a flex cable connector 410 for receiving a mating section 422 of an electrical component 420. The electrical component 420 may correspond to a printed circuit board, or a connector board upon which integrated circuits and additional functionality is extended. The flex connector 410 includes a cavity 435 into which a flex cable 452 extends. While embodiments such as shown in FIG. 4 and elsewhere in the application show that ingress and egress of the flex cable 452 occurs through the body of the connector, other embodiments may provide that ingress/egress of any flex cable described with a particular embodiment occurs from outside of the connector body. A mating section 455 of the flex cable 452 is mounted to a front wall 442 of the cavity 435. One or more electrical contacts 456 extend from the flex cable 452. A coupling structure 440 is provided on a back wall 444 of the cavity 435. The coupling structure 440 may be constructed and operated similar to other embodiments described with, for example, FIGS. 2A and 2B.

A widthwise dimension of the cavity 435 is sufficient to receive the mating section 422 only after the thickness t of the coupling structure 140 in its original, unbiased state is reduced by the force applied to the edge surface 445. In a configuration shown by FIG. 4, the coupling structure 140 is deflected inward by the insertion force being applied orthogonally to an edge surface 445. Application of the insertion force causes an outward facing surface 455 of the coupling structure 440 to be moved towards the back wall 444 of the cavity 435. The coupling structure 440 may be sufficiently rigid so that the coupling structure maintains its shape when it is moved inward. For example, the outward facing surface 455 may remain substantially linear as it is moved inward, so that sufficient space can be provided within the cavity 435 for receiving the component 420.

The insertion force may be applied by a mechanism such as lever arms 150 (FIG. 1). Alternatively, the insertion force may be applied by a tool, such as a stylus that is directed manually into the edge surface 445. It is even possible for a contact surface 424 of the mating component 120 to apply the insertion force onto the edge surface 445.

While the applied insertion force is orthogonal to the edge surface 445, the affect of the insertion force is that the coupling structure 440 deflects towards the second surface 444 of the cavity 135. The thickness t of the coupling structure 140 is thus reduced by the force applied orthogonally to the edge surface 445. A resulting bias of the coupling structure 440 presses against the mating section 422 of the mating component 420. When the mating section 422 is sufficiently inserted into the cavity 435, an active connection is thus formed between electrical elements on a front surface 427 of the mating section and the electrical contacts 456 of the flex connector 410.

In an embodiment, the electrical connection formed within the cavity 435 connects cable 452 with circuitry and other functionality provided on the component 420. The cable 452 may be extended to some other component, such as another printed circuit board. The insertion force applied to the coupling structure 440 enables the component 420 to be mated within the cavity 435 with about zero force applied to the mating component itself or to electrical contacts 456. As a result, sensitive electrical contacts and elements are protected in the insertion and mating step. Furthermore, the strength the active connection formed in the cavity 435 ensures that the electronic connection is stable, and that elements forming the electronic connections are relatively static with respect to one another.

Figure 5C:
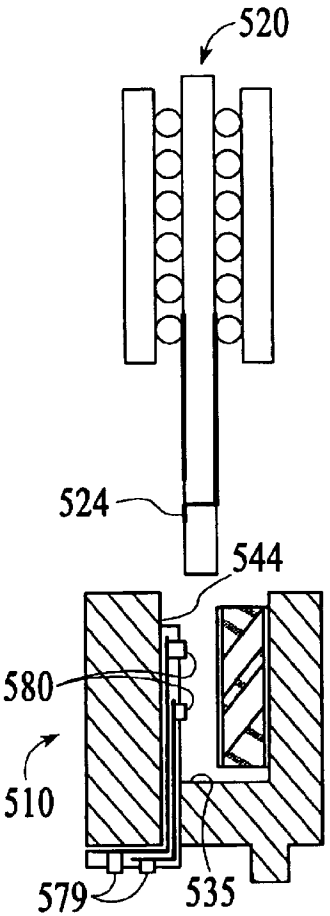
FIGS. 5A–5G are side cross-sectional views of different embodiments of substrate connectors where a coupling structure is provided within a cavity opposite to where conductive elements are provided.
Figure 5B:
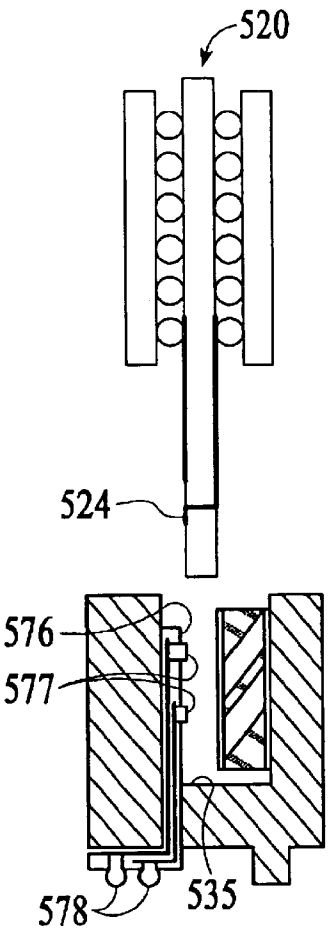
Figure 5A:
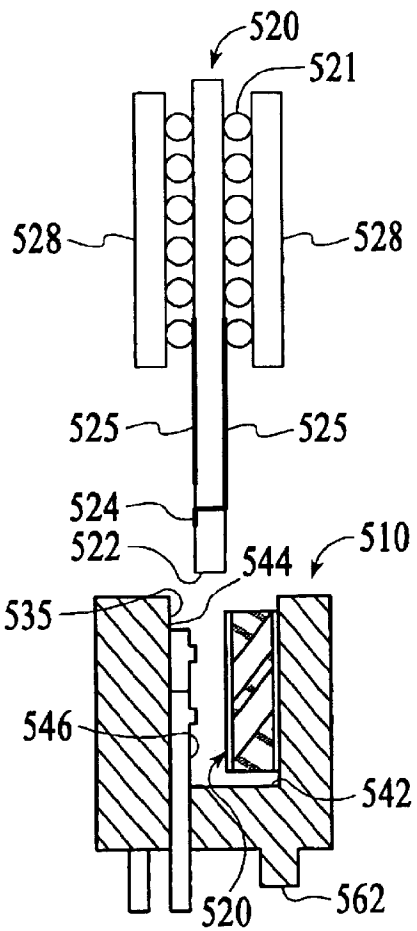

FIGS. 5A–5C illustrate different types of connectors that mount onto substrates and other printed circuit boards, incorporating an embodiment of the invention. In FIG. 5A, a connector 510 includes a cavity 535 in which a coupling structure 540 is provided. The coupling structure 540 may function as described above, such as with FIGS. 1–4. The connector 510 is configured to mate with component 520. A matins end 522 of the component 520 includes contact elements 524 and circuit paths 525. The circuit paths 525 extend to substrates 528 mounted onto a surface of the component 520. The electrical components 528 may correspond to integrated circuit packages, flip chips and modules, or other functionality. Solder balls 521 or other connecting means may be used to mount the electrical components 528 to the mating component 520.

Within cavity 535, lead frames 546 are extended. The lead frames 546 provide an example of one type of contact element that can be used on connector 510. The lead frames 546 are exposed on a front wall 544 of the cavity 535, while the coupling structure 540 is provided on a back wall 544. As described with previous embodiments, the coupling structure 540 provides a bias that creates an active electrical connection between contact elements 524 and lead frames 546. The lead frames 546 extend from the cavity 535 to the underlying substrate (not shown).

The connector 510 may also include a guide member 562 provided on an underlying surface of the connector 510. The guide member 562 may be used as a guide to mount the connector 520 onto an underlying substrate (not shown). For example, a specific aperture or opening may be provided on a printed circuit board where the connector 510 mounts. The guide member 562 is shaped to facilitate clamping connector 510 down on the board in a correct orientation, so that lead frames 546 make correct electrical connection with corresponding elements on the board.

In FIG. 5B, connector 510 is reconfigured to replace lead frames 546 with a flex connector 576 which extends adjacent to the front wall 544 of the cavity 535. Electrical bumps 577 provide the connection mechanism for the flex connector 576 within cavity 535. The electrical bumps 577 may make contact with the contact elements 524 when the mating component 520 is inserted and actively connected to the connector 510. In the example shown by FIG. 5B, the connector 510 may be permanently mounted on the underlying substrate through sadder balls 578 or other permanent attachment mechanism.

FIG. 5C illustrates a configuration in which connector 510 can be removeably mounted onto the underlying substrate. Connector elements 579 are provided underneath the connector 510, which can be pressure-mounted to an the underlying substrate. Connector balls 580 are provided with the cavity 535 adjacent to the front wall 544 for mating with the contact elements 524 of the mating component 520.

Figure 5F:
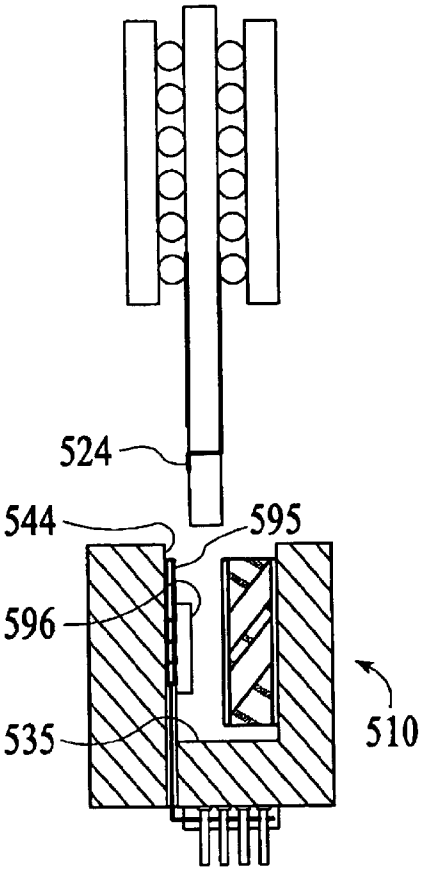
Figure 5E:
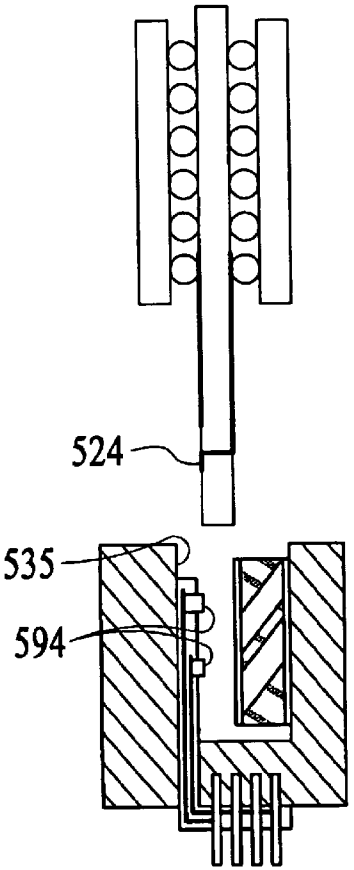
Figure 5D:
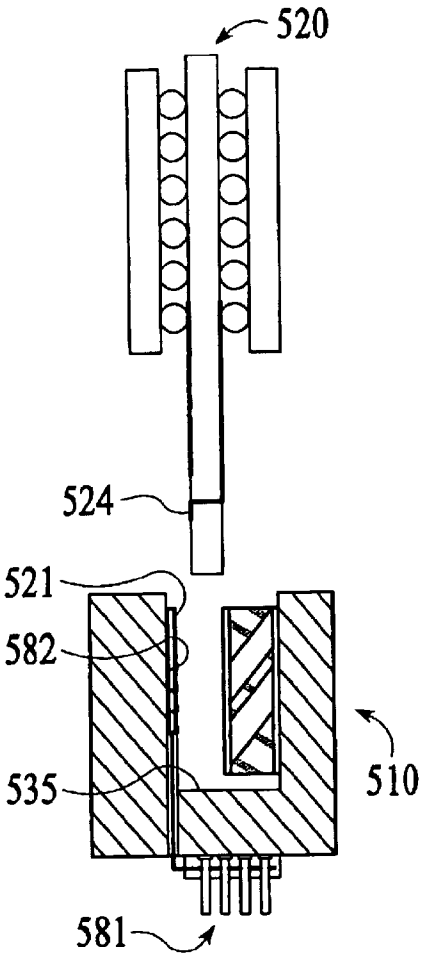

FIG. 5D illustrates another configuration where a pin connector 581 is provided underneath the connector 510 for connecting the connector to the underlying substrate. A semi-rigid flex member 581 may be extended through the cavity 535 and placed adjacent to the front side 533. Molded channels with conductive inlays 582 may establish the electrical connection with contact surfaces 524 of the mating component 520. The pin connector 581 extends that, electric connection with the contact surfaces 524 to the underlying substrate.

FIG. 5E illustrates a configuration similar to FIG. 5D, except that an insulative material with leads terminating in conductive bumps 594 are provided adjacent to the front wall 544 of the cavity 535.

FIG. 5F illustrates a configuration where a vertical connector element 596 element is place in the cavity adjacent to the front-wall 544. The vertical connector element 596 may be formed of anisotropic materials that provide vertical-only conductive paths on a rigid flex material 595 mounted to the front wall 544 of the cavity 535. This vertical connector element 596 accounts for non-uniformities in height (along the axis Z) for contact surfaces 524, connector elements mounted adjacent to the front side 533, or the connection formed therebetween.

Figure 5G:
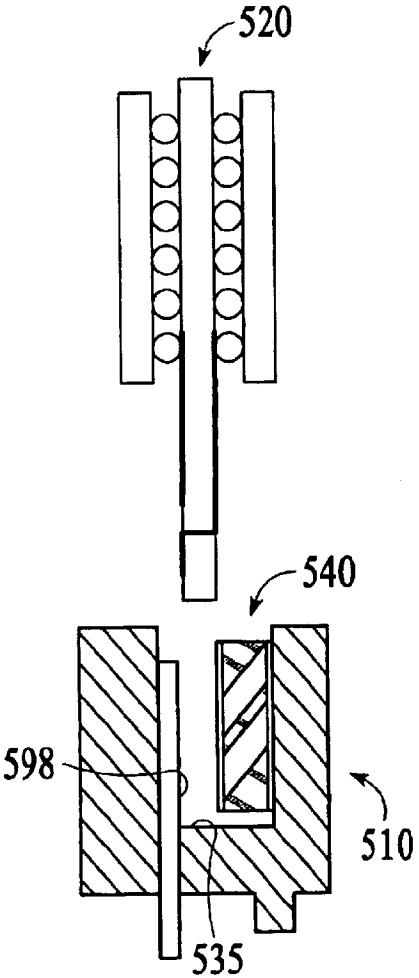

In FIG. 5G, a conductive plate 598 is positioned within cavity 535, opposite the coupling structure 540. When the component 520 is inserted, the coupling structure 540 deflects and the conductive plate 598 is contacted by contact surfaces 524 of the component 520.

Figure 6:
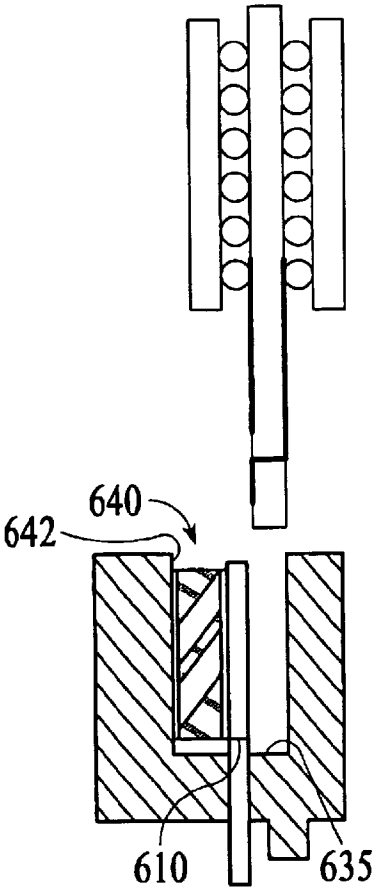
FIG. 6 is a side cross-sectional view of an alternative embodiment where a connector has a coupling structure and a conductive element on the same side of the connector cavity.

FIG. 6 is side cross-sectional view that illustrate an alternative constructions for a connector 610 using a coupling structure 640 such as described in FIGS. 2A and 2B. In FIG. 6, coupling structure 640 is placed on the same side of a connector cavity 635 as a conductive contact element 646 for that connector 610. When an insertion force is applied to the coupling structure 640, coinciding with mating component 620 being inserted into the cavity 635, coupling structure 640 deflects towards front side 642 of the cavity 635. The contact element 646 is fixed to the coupling structure 640 and moves inward towards front walls 642 with the coupling structure's deflection.

Figure 7A:
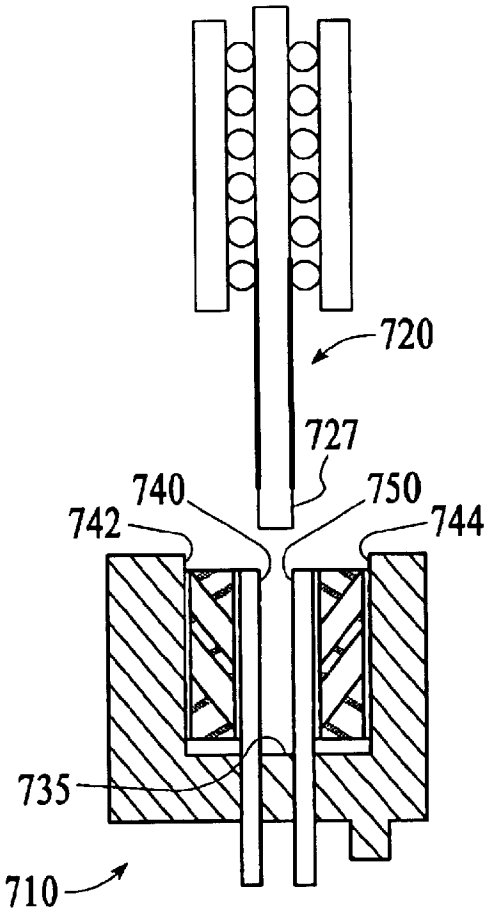
FIGS. 7A and 7B are side cross sectional views of another alternative embodiment where the coupling structure is placed on two or more connector cavity walls.
Figure 7B:
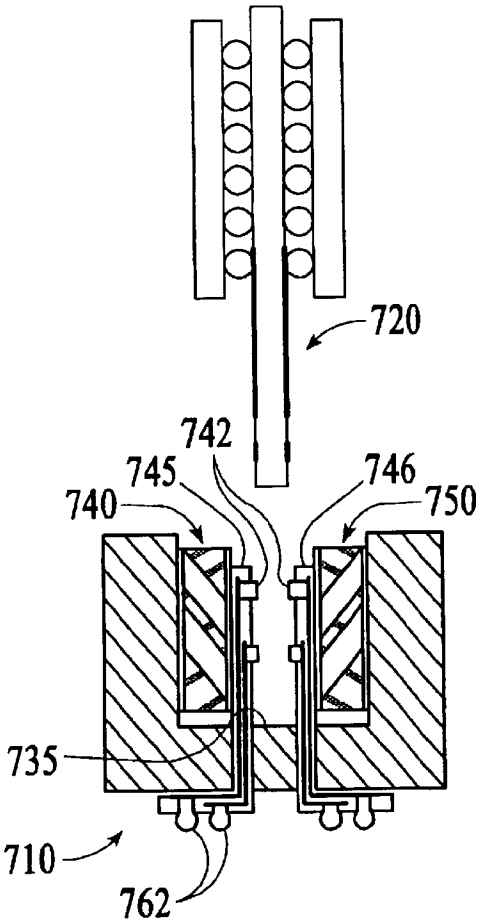

FIGS. 7A–7B illustrate another alternative construction for a connector 710, where a coupling structure is placed on two opposing sides of the connector's cavity 735. In FIG. 7A, a first coupling structure 740 and a second coupling structure 750 are positioned at a respective front side 742 and back side 744 of the cavity 735. The insertion force causes both the first coupling structure 740 and the second coupling structure 750 to deflect inward towards the respective front side 744 and back side 745, thereby making the cavity 735 sufficiently large to receive the mating component 720. When both coupling structures deflect, the mating end 722 of the mating component 720 can be accommodated within the cavity 735.

FIG. 7B illustrates an embodiment similar to FIG. 7A, except that a pair of flex cable 745, 746 are extended into the cavity 735. The flex cables 745, 746 are extended over the coupling structures 740 and 750 provided on the opposing sides of the cavity 735. Conductive bumps 748 are provided on each cable 745, 746 so that mating component 720 can make an electrical connection with connector 710 on two opposite facing sides. Solder (SP) balls 762 connect the flex cables 745, 746 to another circuit board or electrical device.

Figure 8:
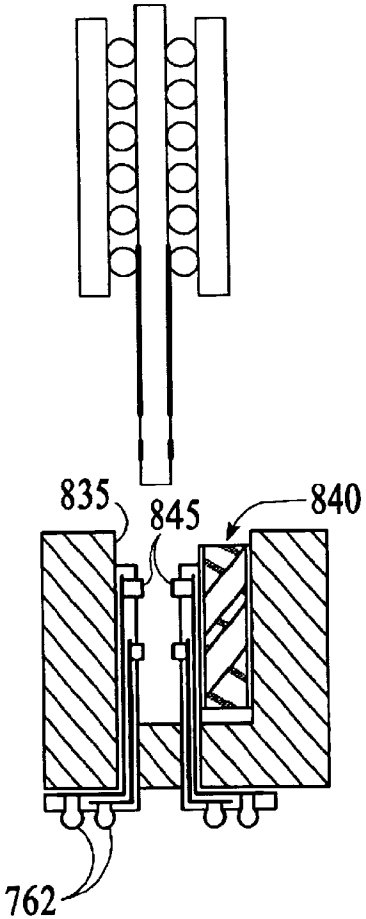
FIG. 8 illustrates another alternative embodiment where conductive elements are placed on two or more connector cavity walls, and one of the walls also contains a coupling structure.

FIG. 8 illustrates an embodiment similar to FIG. 7B, except that a coupling structure 820 is provided on only one side of a connector cavity 835. The flex cable 845, 846 (or other conductive surface) are provided on both opposing sides of the cavity 835. In this configuration, electrical contact is made on two sides of cavity 835, while coupling structure 840 deflects on one side of the cavity.

ALTERNATIVE DESIGNS AND CONCLUSION

While embodiments described herein provide for the coupling structure (such as described in FIGS. 2A and 2B) to provided within a cavity, an alternative design may provide some or all of the coupling structure on a male component of a connector assembly. Thus, for example, with reference to FIG. 1B, coupling structure 140 may be provided on one of the surfaces of the mating section 122. Alternatively, the coupling structure 140 may be provided on both the front wall 142 of the cavity and on, for example, the back surface 123 of the mating component 120.

While certain aspects of the invention are presented below in certain claim forms, the inventor contemplates the various aspects of the invention in any number of claim forms. Accordingly, the inventors reserve the right to add additional claims after filing the application to pursue such additional claim forms for other aspects of the invention.

What we claim is:

1. A connector comprising:

a structure defining a cavity;

one or more electrical contact elements provided on the structure; and a coupling structure formed from a matrix material comprising a plurality of discrete elements, the plurality of discrete elements being aligned to receive an insertion force for inserting a mating component into the interior cavity, wherein the plurality of discrete elements are structured so that the insertion force is distributed substantially uniformly amongst multiple discrete elements in the plurality of discrete elements that are part of a portion of the coupling structure that is affected by the insertion force, the discrete elements in the portion being forced from an original state into a biased state, wherein when the elements are in the biased state, a thickness of the coupling structure is reduced; and wherein a dimension of the cavity is proportional to the thickness of the coupling structure, so that the dimension of the cavity is increased when the thickness of the coupling structure is reduced.

2. The connector of claim 1, wherein before the insertion force is applied, the plurality of discrete elements include a set of discrete elements that have a first skewed orientation with respect to a primary direction in which the insertion force is to be applied, and wherein the set of discrete elements are aligned to skew more from the first skewed orientation when affected by the insertion force.

3. The connector of claim 2, wherein after the insertion force is applied, the set of discrete elements are biased to reduce in skew towards the first skewed orientation.

4. The connector of claim 1, wherein each of the discrete elements includes a member that is transverse and skewed relative to a primary direction of the insertion force.

5. The connector of claim 1, wherein the member of at least some of the discrete elements are aligned to be deflected and become more skewed relative to the primary direction of the insertion force when the insertion force is applied.

6. The connector of claim 1, wherein the member of each element in the plurality of discrete elements is configured to have a bias towards not having skew after the insertion force is applied and the mating component is inserted, and wherein the bias coincides with the coupling structure pressing against the mating component.

7. A connector assembly comprising:

a connector comprising a mating section upon which a first plurality of contact elements are distributed;

a component comprising a cavity for receiving the mating section, and the component having a second plurality of contact elements;

a coupling structure disposed on a surface of at least one of the mating section and the cavity, the coupling structure being formed from a matrix material comprising a plurality of discrete elements, the plurality of discrete elements being aligned to be affected by an insertion force for inserting the component into the cavity, wherein the plurality of discrete elements are structured so that the insertion force is distributed substantially uniformly amongst multiple elements in the plurality of discrete elements that are part of a portion of the coupling structure that is affected by the insertion force, the discrete elements in the portion being forced from an original state into a biased state, wherein when the discrete elements are in the biased state, a thickness of the coupling structure is reduced; and wherein a dimension of the cavity with respect to a size of the mating section is proportional to the thickness of the coupling structure, so that the dimension of the cavity accommodates the mating section only after the thickness of the coupling structure is reduced.

8. The connector apparatus of claim 7, wherein the coupling structure is disposed on the surface of the mating section.

9. The connector apparatus of claim 7, wherein the coupling structure is disposed on the surface of the cavity.

10. The connector apparatus of claim 7, wherein the coupling structure is disposed on both the surface of the mating section and the surface of the cavity.

* * * * *